US006338302B1

(12) United States Patent
Montagner

(10) Patent No.: US 6,338,302 B1
(45) Date of Patent: Jan. 15, 2002

(54) ARM SUPPORT ELEMENT FOR WRITING DESKS

(75) Inventor: Silvio Montagner, Mansue' (IT)

(73) Assignee: Eurocomponenti Srl, Portobuffole' (IT)

( * ) Notice: Subject to any disclaimer, the term of this patent is extended or adjusted under 35 U.S.C. 154(b) by 0 days.

(21) Appl. No.: 09/557,472

(22) Filed: Apr. 21, 2000

(30) Foreign Application Priority Data

Apr. 23, 1999 (IT) ..... VI99U000032

(51) Int. Cl.[7] ..... A47B 13/08
(52) U.S. Cl. ..... 108/90; 108/152
(58) Field of Search ..... 108/90, 97, 134, 108/135, 152, 43; 248/918

(56) References Cited

U.S. PATENT DOCUMENTS 3,181,485 A * 5/1965 Dotson et al. ..... 108/152 X
3,289,615 A * 12/1966 Marschak ..... 108/97
3,301,406 A * 1/1967 Scott ..... 108/97
3,741,131 A * 6/1973 Leadbetter ..... 108/152 X
4,846,432 A 7/1989 Skewis
4,976,407 A 12/1990 Schwartz et al.
5,036,777 A * 8/1991 Barton ..... 108/90
5,317,977 A * 6/1994 Omessi ..... 108/97
5,342,006 A * 8/1994 Tice ..... 248/918 X
5,862,933 A * 1/1999 Neville ..... 108/43 X

FOREIGN PATENT DOCUMENTS

DE 93 17 629 U 1/1994
WO WO 99 27816 A 6/1999

* cited by examiner

*Primary Examiner*—Jose V. Chen
(74) *Attorney, Agent, or Firm*—Dykema Gossett PLLC

(57) ABSTRACT

The disclosure concerns a support element for the arms, especially suitable for application on writing desks and comprising: a body, substantially flat and shaped in such a way as to allow a person to comfortably rest his/her forearms on it and suitable for being positioned partially overlapping the top of the writing desk; at least one stay element having a first end fixed to the body in correspondence with the surface pressing against the writing desk and a second free end whose distance from the surface of the body to which the first end is fixed is substantially equal to the thickness of the top of the writing desk, the second end pressing against the top of the writing desk in correspondence with the surface on the other side of the top. According to a preferred form of execution, the second free end is provided with an adjustable compensation element that presses without locking against the surface on the other side of the top.

11 Claims, 4 Drawing Sheets

ARM SUPPORT ELEMENT FOR WRITING DESKS

The invention concerns a support element for the arms, in particular for the forearms, of the user of a writing desk.

The invention is particularly useful for persons who use computers and the support element is particularly useful to rest the forearms when the hands are busy typing on the computer keyboard.

As already known, nowadays office writing desks of the so-called "operational" type are standardised even in their dimensions and the most common depth for this kind of writing desks is approximately 80 cm. This is due to obvious reasons of space, especially when the writing desks are located in the so-called "open offices" or in conditions in which space economy is indispensable.

It is also known that computers are rather cumbersome, especially the personal computers positioned on 80 cm deep writing desks, and that the operators have little space to find an ergonomic position, that is, to find the optimal position for their body.

It is also important to point out that according to the latest regulations computer operators must be seated at a certain distance from the screen, so that the radiations cannot affect their health and their sight can be sufficiently protected.

It is clear that a writing desk that is not sufficiently deep, as mentioned above, and the considerable dimensions of the computer and the keyboard do not allow the operator to find the optimal working position. The operator, in fact, should move backwards with respect to the writing desk and be positioned quite uncomfortably, with suspended forearms. This is obviously an uncomfortable position and over time it may cause sore arms or other troubles.

According to the German utility implement DE-G 93 17 629.5, a support element is prescribed for the pointer mouse of a computer to be connected to the top of a writing desk by means of a clamp belonging to the support element and whose screw locks against the lower surface of the writing desk. It is clear that to apply the support element or remove it from the writing desk the clamp's screw has to be turned. This creates the inconvenience that it may be troublesome and even strenuous to turn the screw because of its location. What's more, if this operation is repeated several times it will also lead to ruining the lower surface of the writing desk where the screw is locked.

The aim of the invention is to eliminate the above mentioned inconveniences.

One of the main goals of the invention is the implementation of a forearm support element that must be easy and quick to apply to the writing desk when necessary and also easy and quick to remove and to store, for example under the desk or in any other place, so that it is not a hindrance.

Another scope to achieve is that the support element can be used indifferently on any writing desks having tops of different thickness.

The intention is also to make the support element, after a first, sole adjustment, remain attached to the writing desk without the aid of fastening devices that have to be locked against the writing desk.

An additional aim to achieve is to be able to remove the support element from the writing desk without having to operate any collapsing elements, but by simply pulling said support element away from the writing desk with a substantially sliding movement.

Another aim of the invention is to implement a support that allows the operators to respect the safety distance prescribed by the regulations in force with no need to change the writing desks they presently use.

Last but not least, an aim to achieve is that the support element, after having been removed from the writing desk, takes up the minimum space possible so that it can even be stored in a drawer. All the aims mentioned above and others that will be described in greater detail below have been achieved through the implementation of an arm support element, for connecting to a writing desk, which, according to the main claim, comprises:

- a substantially flat body, shaped so that the forearms can comfortably rest on it and suitable for being positioned partially overlapping the writing desk top;
- at least one stay element attached to said body and pressing against said top of said writing desk, and wherein said at least one stay element consists of a body with a shaped linear construction having a first end fixed to said body in correspondence with the surface resting on the writing desk and a second free end, whose distance from the surface of said body to which the first end is fixed is substantially equal to the thickness of the writing desk top, said second end pressing against the top of said writing desk in correspondence with the surface on the other side of the top.

To advantage, according to the invention the support element does not require any locking element, like clamps or screws, to be fixed to the writing desk, but it remains fastened to the writing desk by the resistance due to the counter force that, through the free end, or through the compensation element, acts against the surface of the writing desk on the opposite side of the top due to the pressure exerted by the arms resting on the support element invention.

What's more the existence of a fixed or even adjustable compensation element on the free end of the stay element, allows the same support element to be used in combination with writing desks having tops of different thickness.

The support element will preferably have a very flat shape with two protrusions joined by a central recess, protrusions on which the computer operator can rest his/her forearms.

At the end of the work with the computer the operator can easily remove the support element, in fact it is sufficient to lift it from the writing desk and put it where desired.

Further characteristics and particulars of the invention will be highlighted in greater detail in the description of some, among many, possible applications of the invention in question, given as a guideline but not limitation and illustrated in the attached drawings, wherein.

Figure 1:
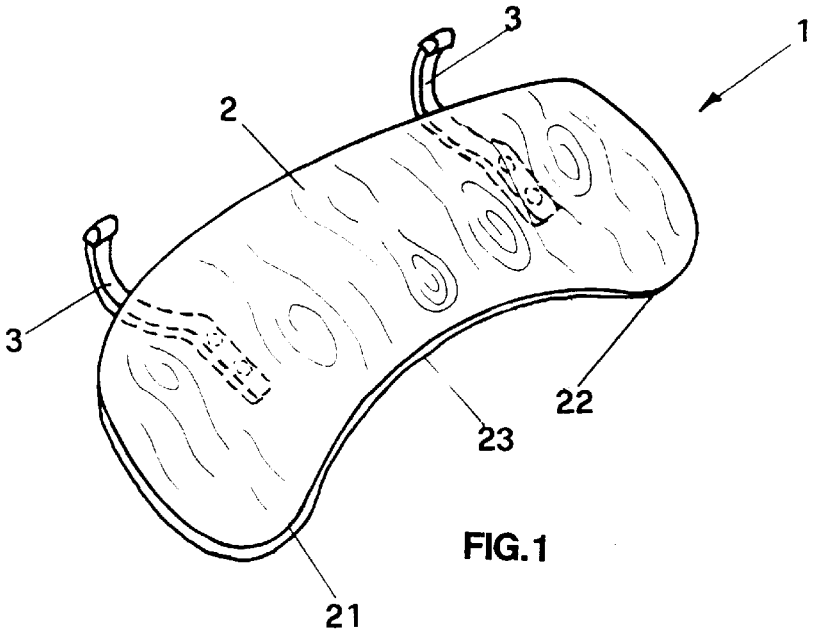
FIG. 1 is a prospect view of the support element object of the invention.
Figure 2:
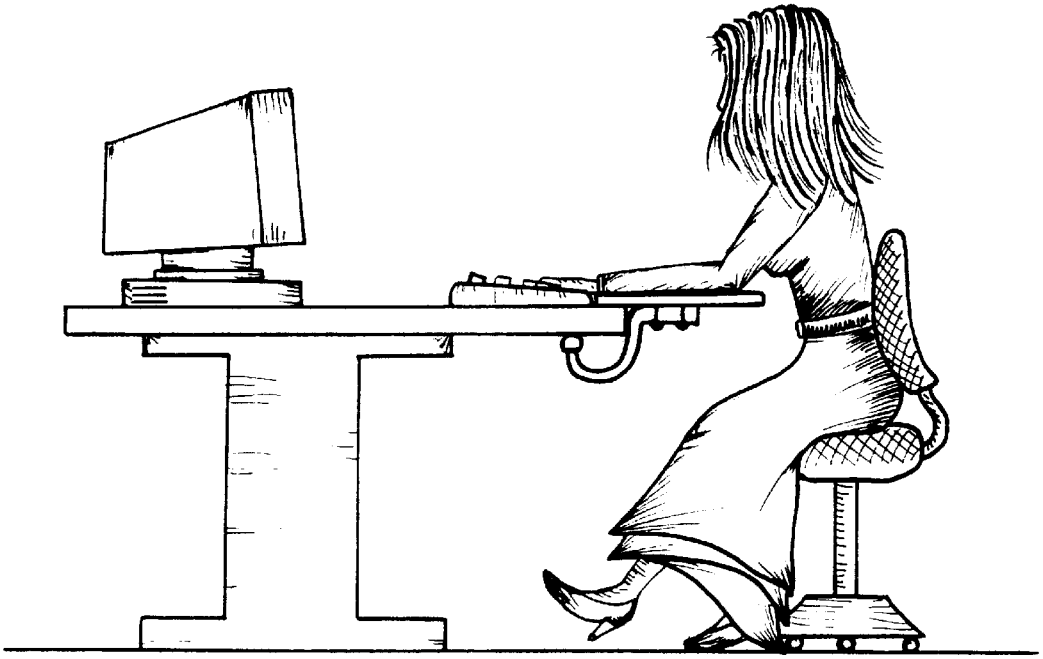
FIG. 2 is a side view of the support element object of the invention applied to a writing desk.
Figure 3:
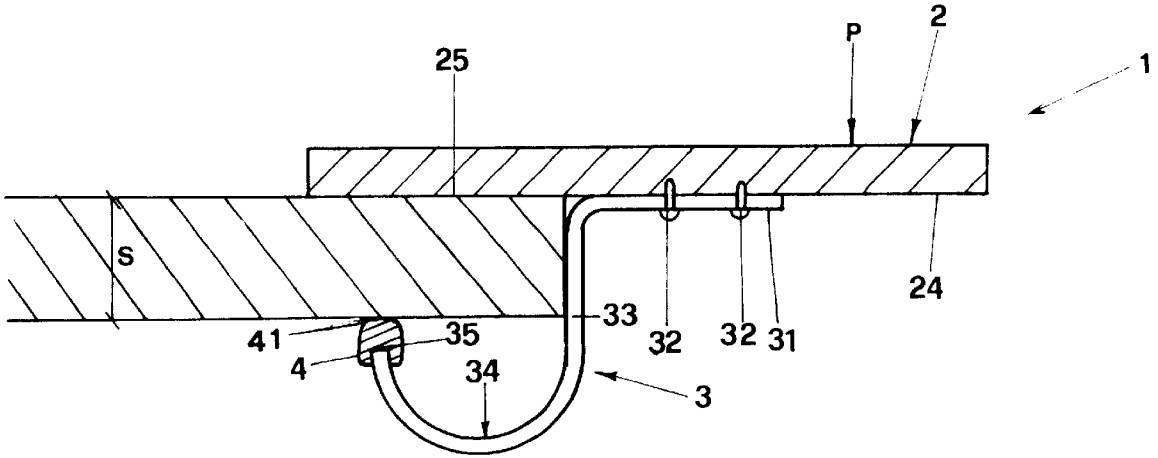
FIG. 3 shows a section of the support element object of the invention applied to the top of the writing desk.

With reference to the mentioned figures and in particular to FIG. 1, it can be observed that the support element, indicated as a whole by 1, is provided with a body 2 with substantially symmetrical shape having two lobeshaped protrusions 21 and 22 joined by a central recess 23. Said body is preferably made of wood or equivalent material or even plastic and is rather thin, for example its thickness can be approximately 8–16 mm. As can be seen in FIG. 3, two properly shaped stay elements having a body with a linear construction, indicated by 3, are fixed with screws in correspondence with the lower surface 24 of said body. More particularly, the stay element 3 is provided with a substantially flat first end 31 with holes 32 through which the screws for the fastening to the lower surface 24 of the body 2 are introduced. The flat end 31 is joined to a central part 33 that is substantially orthogonal with respect to the end 31 and continues with a curve part 34 terminating with an end 35 on which a terminal compensation element 4 is applied. This compensation element 4, which, for example, can be made of plastic or equivalent material and in this example has the shape of plug, is fitted in correspondence with the free end 35, so that he distance between top end 41 of said compensation element and the surface 24 is substantially equal to the thickness S of the writing desk top.

Obviously, when the operator rests his/her forearms on the support, he/she applies a load P, as shown in FIG. 3, but nevertheless the support element I cannot rotate, or move, or overturn with respect to the top, since it is caught between section 25 of the surface 24 and the end 41 of the compensation element 4.

Figure 5:
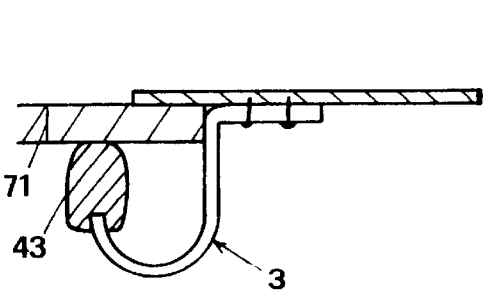
FIGS. 4 and 5 show two support elements with different compensation elements.
Figure 4:
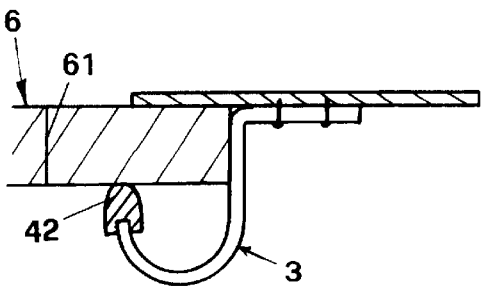

In order to make it possible to use the same support element on writing desks whose tops have different thicknesses, the invention, according to the illustrations in FIG. 4 and FIG. 5, prescribes that the difference in thickness can be compensated by changing the height of the compensation element.

FIG. 4 shows how the top 6 with thickness 61 works with the stay element 3 whose free end is provided with the compensation element 42, said compensation element 42 having an height that allows it to rest against the lower surface of the top 6. The same can be observed in FIG. 5, where the top 7 has a thickness 71 inferior to the thickness 61 of the top 6. In this case the same stay element 3 is provided with a compensation element 43 with increased height, so that its upper part can in any case rest against the lower surface of the writing desk top.

As it can be observed, by simply changing the compensation elements it is possible to apply a single support element to writing desk tops with different thickness.

Figure 6:
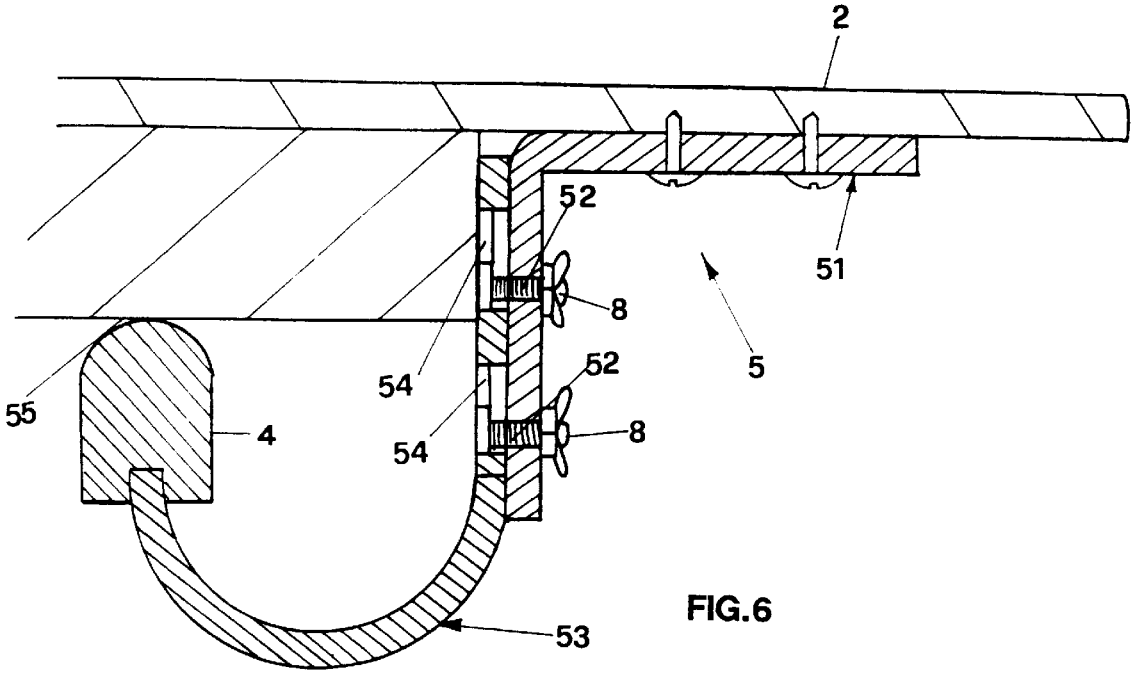
FIG. 6 shows a cross section of a variant in execution of the invention with adjustment of the stay element with respect to the top of the writing desk top.

FIG. 6 shows another system to adjust the distance between the support element and the top of the writing desk. In this case the stay element, indicated as a whole by 5, is provided with a first part 51 that is fixed to the body 2 of the support element using, for instance, screws. This part 51 is L-shaped and, as shown in the example, is provided with two holes 52 through which the screws 8 pass. The second part of the compensation element consists of the substantially U-shaped iron part indicated by 53 and provided with two slots 54 that permit the adjustment of the distance between the top end 56 of the compensation element 4.

As it can be observed, even the stay element 5 can be adjusted as effectively as the compensation element present in the examples of FIGS. 4 and 5.

Figure 7:
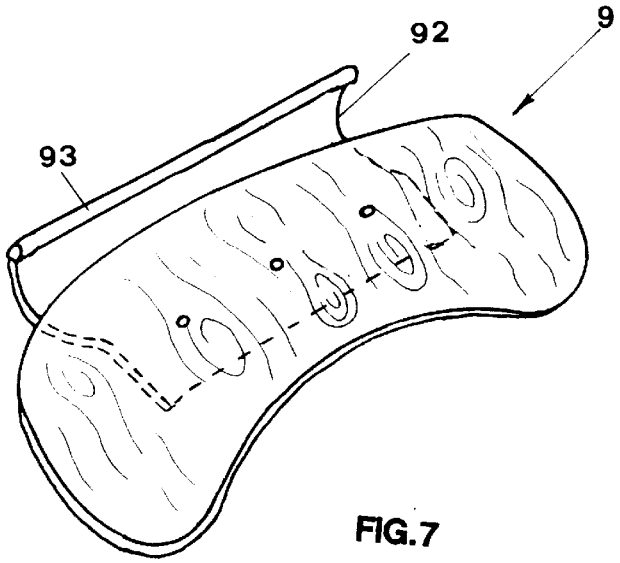
FIG. 7 shows another variant of the invention.

FIG. 7 shows another variant of the support element, indicated as a whole by 9, provided with a single stay element 10 made with a single sheet or moulded plastic part having substantially the same shape as the iron elements 3 and fixed with screws to the lower surface of the body of said support element 9.

Even in this case the height of the free end 93 of the stay element 92 must be lower than the height of the surface where the first end of the stay element is fixed and the difference in height must be substantially equal to the thickness of the writing desk top onto which the support element is applied.

Figure 8:
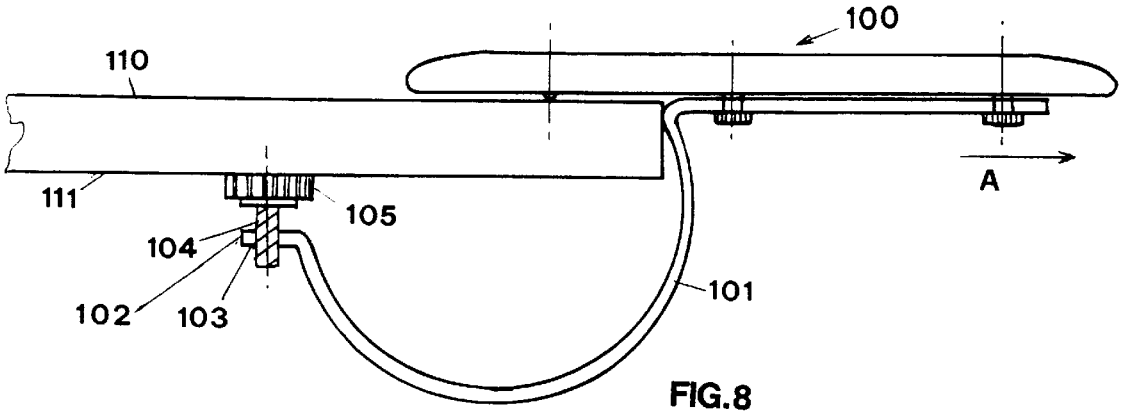
FIG. 8 shows a cross section of another variant of the invention.

Another example of compensation in order to use the same support element on writing desks with different thicknesses is shown in FIG. 8. In this case the support element 100 has at least one stay element 101 that has a threaded hole 103 in its free end 102 which holds a screw 104 with a substantially cylindrical head 105 suited to being turned by hand. This screw 104 functions as an adjustable compensation element.

For the support element invention to work well, in the example given in FIG. 8, it is sufficient that on its first use, in other words when the support element 100 is attached to the desk top 110 for the first time, screw 104 is adjusted so that its head 105 only just rests, without locking, against the lower surface 111. Basically, the screw 104 does not act as a clamp that would lock the stay element to the top, but solely acts as a free adjustable support. In this way the support 100 can be removed from the top by simply moving said support in the direction of arrow A without touching the screw 104. In the same way, to return the support element to the desk top, it is enough to fit the support element by moving it with a substantially horizontal sliding movement in the opposite direction to the arrow A.

Figure 9:
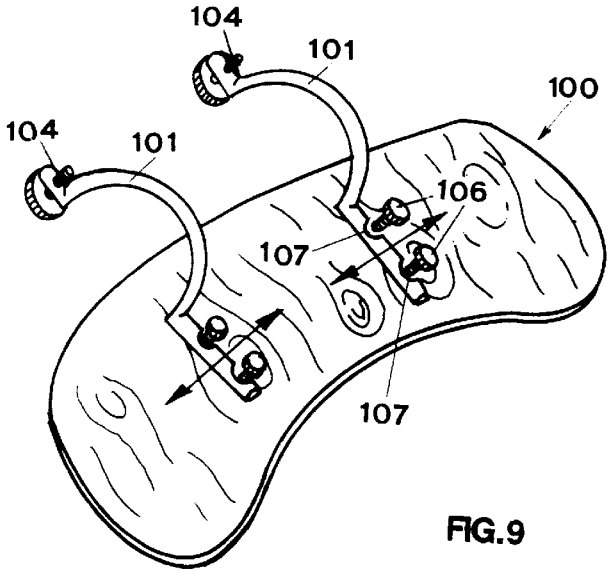
FIG. 9 shows details of the connection between the support element in FIG. 8 and the stay elements.

FIG. 9 shows how the stay elements 101 are fixed to the lower surface of the support element 100 by screws 106 that work with slots 107 found on the ends of the stay elements 101. The slots 107 are provided to make it extremely easy to separate the stay elements 101 from the support element 100, it being sufficient to slacken the screws 106 without unscrewing them completely from their holes. This is especially useful when the support element is not used for long periods of time and has to be stored for instance in a drawer, without taking up too much space.

What is claimed is:

1. A support for engaging the top of a writing desk, said support comprising:

a substantially flat body having an upper surface and an underside capable of being positioned for partially overlapping and engaging the desk top adjacent the edge;

at least one stay element for removably securing the body to the desk top, said stay element has a first end secured to the underside of the flat body, a free end being disposed in spaced apart relation from the flat body by a lateral distance corresponding to the thickness of the desk top, and an intermediate portion extending between the first end and the free end, said intermediate portion is perpendicular to said first end and is for engaging the end of the desk top, said body for engaging the upper surface of the desk top and said free end for engaging the lower surface of the desk top, said at least one stay element has an adjustable compensation element for varying the position of the lateral distance between the free end of the flat body, and said compensation element for accommodating the varying thickness of the desk top and for adjusting the position of the rest relative to said desk top.

2. The support of claim 1, wherein said compensation element includes a stationary plug secured to the free end of the stay element.

3. The support of claim 1, wherein said compensation element comprises:

a screw having a cylindrical hand movable head secured to the free end of the stay for varying the position of said free end relative to the body.

4. The support of claim 1, wherein the intermediate portion of the stay element has slotted portions for allowing lengthwise adjustment of the stay.

5. The support of claim 4, wherein the compensation element has screws for engaging the slots to secure the intermediate portion in a selected position.

6. The support of claim 1, wherein the body has a symmetrical shape.

7. The support of claim 6, wherein the body has two protrusions extending from a side thereof away from the stay element, and an intermediate recess between said protrusions.

8. The support of claim 1, wherein the first end of the at least one stay element has slotted openings and means to adjustably secure the first end to the underside of the body for positioning the body in parallel spaced relation relative to the free end and positioning the body laterally relative to the edge of the desk top when in use.

9. The support of claim 8, wherein the means to adjustably secure the end of the at least one stay element to the body includes a movable screw.

10. The support of claim 1, wherein the at least one stay element is a thermoformed element.

11. The support of claim 1, further including a stop on the underside of the body for engaging the edge of the desk top.

* * * * *